United States Patent [19]

Krupnicki

[11] Patent Number: 5,004,865

[45] Date of Patent: Apr. 2, 1991

[54] SPLICING DEVICE FOR FLUID-COOLED ELECTRIC CABLES

[76] Inventor: Theodore A. Krupnicki, 565 Adams Rd., Webster, N.Y. 14580

[21] Appl. No.: 418,499

[22] Filed: Oct. 10, 1989

[51] Int. Cl.[5] ..... H01B 7/34

[52] U.S. Cl. ..... 174/15.7; 174/15.6; 174/21 R; 174/84 C

[58] Field of Search ..... 174/15.6, 15.7, 21 R, 174/84 C; 285/133.1; 403/285

[56] References Cited

U.S. PATENT DOCUMENTS

| | | | |
|---|---|---|---|
| 1,784,384 | 12/1930 | Paugh | 174/15.7 X |
| 2,701,818 | 2/1955 | Tims | 174/15.7 X |
| 2,740,059 | 3/1956 | Conery | 174/21 R |
| 2,888,510 | 5/1959 | Tribe | 174/15.7 |
| 3,976,385 | 8/1976 | Klopfer | 174/84 C X |
| 4,442,312 | 4/1984 | Oshkin et al. | 174/15.7 |
| 4,745,239 | 5/1988 | Conrad | 174/84 C X |

*Primary Examiner*—Morris H. Nimmo

*Attorney, Agent, or Firm*—Warren W. Kurz

[57] ABSTRACT

A device for splicing together two lengths of fluid-cooled, electric cable of the type comprising an electrical conductor surrounding by a flexible conduit through which a cooling fluid, e.g., water, can flow for the purpose of conducting thermal energy away from the cable while the cable conducts high current. The splicing device comprises an electrically-conductive tubular member having a pair of spaced holes in the tube wall. The tubular member is adapted to be crimped at both ends upon the respective ends of the conductor portion of two lengths of such cable, and the outside diameter of such member is substantially equal to the inside diameter of the flexible conduit portion of the cable so that the respective ends of the conduit portion of such two lengths of cable can snugly slide over the tubular member from opposite ends. The holes are located in the tubular member to allow fluid to flow substantially uninterrupted from one cable length, through the tubular member, to the other cable length.

5 Claims, 2 Drawing Sheets

SPLICING DEVICE FOR FLUID-COOLED ELECTRIC CABLES

BACKGROUND OF THE INVENTION

The present invention relates to fluid-cooled electric cables of the type commonly used, for example, in welding equipment for the purpose of supplying a welding torch or "head" with exceptionally high current. More particularly, this invention relates to improvements in splicing devices of the type used for joining together two lengths of such cables.

Various types of electric welding equipment and electric furnaces require flexible cables capable of carrying high current loads, of the order of hundreds of amperes. Typically, such cables take the form of a braided wire conductor surrounded by a relatively soft and flexible tube or sleeve, such as neoprene. In addition to providing electrical insulation from the wire conductor, such tube serves to maintain a pressurized cooling fluid, usually water, in heat-conducting relationship with the conductor as the latter conducts high current. Electric cables of this type are sold in long lengths, e.g., increments of fifty feet, since they are often required to span long distances between power supply and welding head. Since welding equipment is commonly used in debris-ridden environments containing sharp edges and shapes, the integrity of the welding cable, particularly the fluid containing tube which surrounds the current-carrying conductor, is continually threatened. An inadvertent tug or pull on the cable in the wrong direction can easily result in a tube-tear or puncture and the need to replace the entire cable. Owing to the heavy-duty nature of such cables, it will be appreciated that the replacement cost is high.

In U.S. Pat. No. 1,784,384, issued to J. J. Paugh in 1930, there is disclosed a metal "plug" and tube arrangement which functions to splice together two lengths of water-cooled welding cable of the above type without interrupting the flow of water through the cable. Thus, in the case of a puncture or tear in the cable's fluid conduit, the damaged portion may be cut out of the cable, and two ends of the resulting two cable portions can be coupled together. The plug component simply comprises a cylindrical member having a pair of opposing counter-bored ends. The tube is concentrically arranged within the plug so that an annular space is provided between the outside of the tubular member and the inside surface of the counter-bored region of the plug. The braided wires of each of the cable portions being spliced together are inserted in this annular space between plug and tube wall and secured there by solder or the like. The two confronting ends of the fluid conduit are slid over the plug and secured thereto by a suitable clamp. Thus, the internal tubular member allows cooling fluid to flow thorugh the plug, from one cable length to the other, while the plug, itself being electrically conductive and soldered to the respective electrical conductors of each cable length, provides the electrical continuity from one cable length to the other.

While the above-described apparatus may function well to splice together two lengths of fluid-cooled electrical cable, a reliable splice requires a time-consuming and, in this case, difficult soldering step to achieve the requisite electrical continuity. If one were to attempt to crimp or otherwise mechanically squeeze the respective plug and tube walls together in order to capture the wire conductor therebetween, there would be a risk of closing the tube opening, thereby restricting the flow of fluid therethrough. Moreover, one would risk distorting the circular cross-section of the plug, thereby making a fluid-tight seal between the two fluid conduits quite difficult.

SUMMARY OF THE INVENTION

In view of the foregoing discussion, and object of this invention is to provide a simple, low-cost splicing device for reliably coupling together the respective ends of two fluid-cooled electric cables of the type mentioned above.

Another object of this invention is to provide a fluid-cooled cable splicing device which requires no soldering step to achieve the requisite electrical continuity between the spliced cable portions.

The cable-splicing device of the invention basically comprises an electrically-conductive tubular member having a pair of spaced holes in the tube wall. Each end of the tubular member is adapted to receive and be crimped tight upon the respective ends of the conductor portions of two cables being spliced together. The holes in the tube wall are located predetermined distances from the respective ends of the tubular member so that, when the tube ends are crimped upon the cable conductors, the central axis of each hole extends at an acute angle relative to the longitudinal axis of the tubular member. The outside diameter of the tubular member is substantially equal to the inside diameter of the flexible, fluid-containing conduit of the cable so that the respective ends of the conduit portion of two cable lengths can be slid over the tubular members from opposite ends and form a fluid-tight seal with the outside surface of the tubular member.

The invention and its various advantages will be better understood from the ensuing detailed description of a preferred embodiment, reference being made to the accompanying drawings.

DETAILED DESCRIPTION OF PREFERRED EMBODIMENTS

Figure 1:
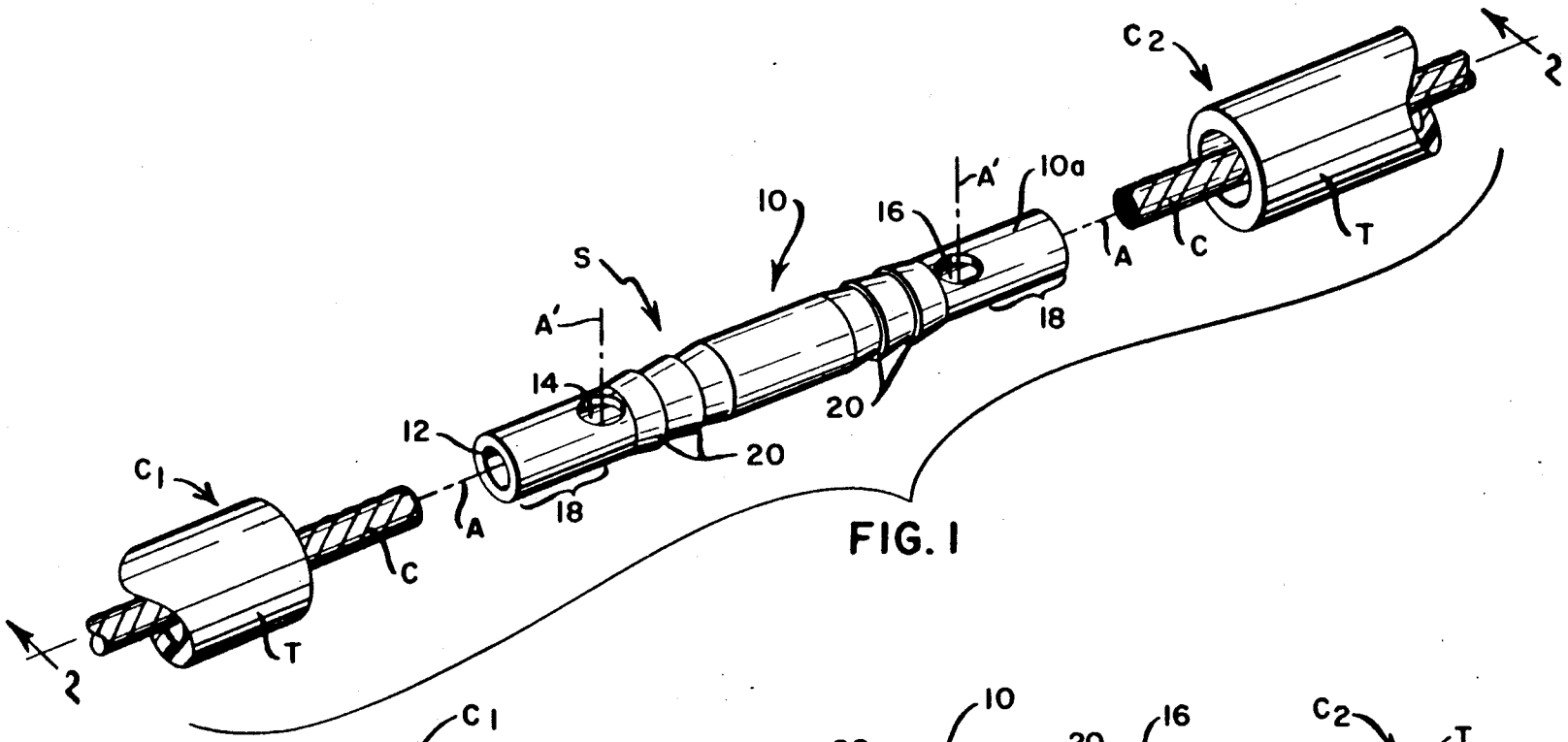
FIG. 1 is a prespective view of a preferred form of the cable splicing device of the invention prior to a splicing operation.
Figure 2:
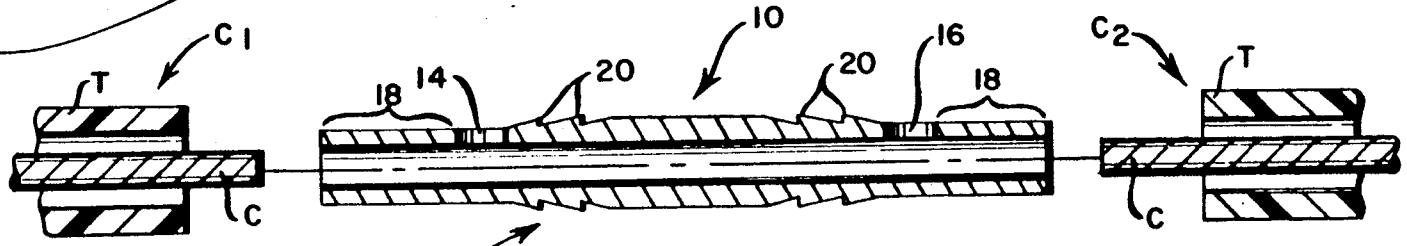
FIG. 2 is a cross-section of the FIG. 1 apparatus taken along the section line 2—2.

Referring now to the drawings, FIG. 1 illustrates a preferred cable-splicing device S for splicing together the ends of two fluid-cooled electric cables C1 and C2. Cables C1 and C2 are of conventional design, comprising a braided wire conductor C having a surrounding flexible tube T which functions as a conduit for a cooling fluid, such as water. As noted above, tube T typically comprises a pliable neoprene rubber or the like.

The cable splicer of the invention comprises a tubular member 10 of electrically conductive material, e.g., copper, brass or aluminum. Member 10 has a cylindrical bore 12 defined by an endless wall 10*a* which concentrically surrounds a longitudinal axis A. The bore-defining wall 10*a* of member 10 is provided with a pair of holes 14, 16 which communicate with bore 12. Holes 14, 16 are preferably located equal distances from the respective ends of member 10 and, prior to being used in a splicing operation (described below), the central axes A′ of holes 14, 16 are nominally perpendicular to axis A. At least that portion of wall 10*a* in the vicinity of the ends of member is of a thickness allowing the wall to be collapsed by a crimping tool in order to capture an iserted end of the braided wire conductor C, as explained below. Holes 14, 16 are spaced inwardly from the ends of member 10, beyond the crimping region 18 of member 10.

Figure 4:
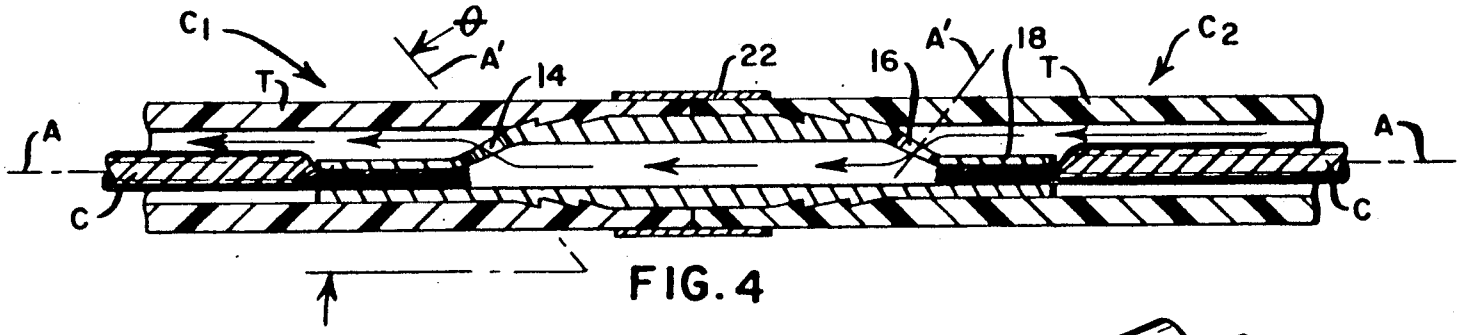
FIG. 4 is a cross-sectional illustration showing the splicing device of FIG. 1 splicing two cables together.
Figure 3:
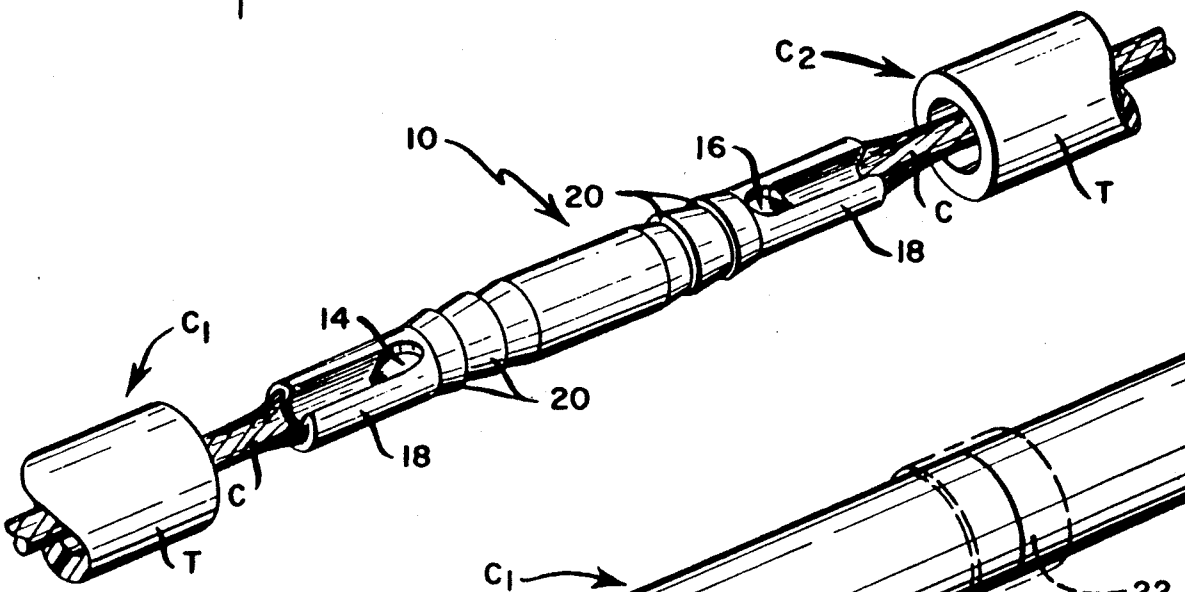
FIG. 3 is a perspective view of the FIG. 1 apparatus after a splicing operation has been effected.
Figure 5:
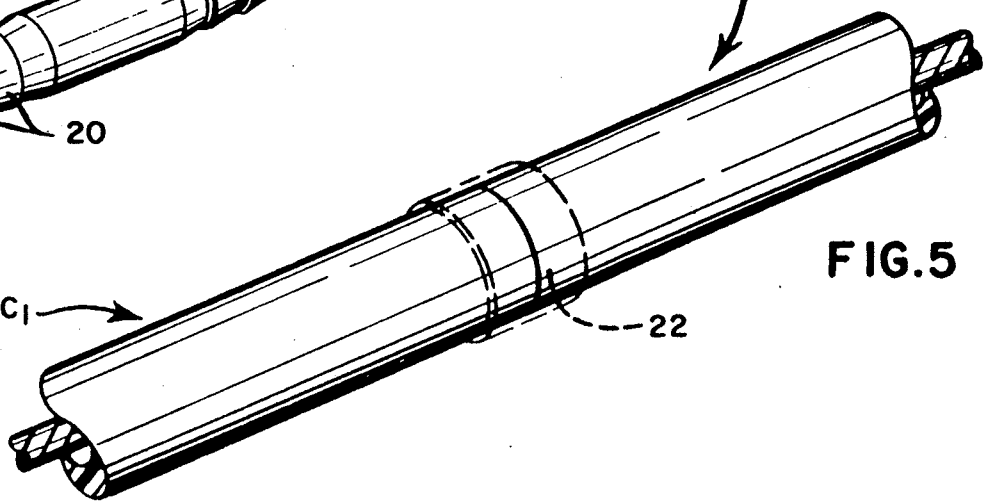
FIG. 5 is a perspective view of a fluid-cooled power cable after having been spliced by the apparatus of the invention.

In use, the respective ends of the flexible tubes of cables C1 and C2 are pulled back to expose a short length, say, 1 cm., of the braided conductors C. The conductor ends are inserted into the bore hole 12 of member 10 from opposite ends, each end being inserted to a point just short of holes 14, 16. A crimping tool or the like is then used to crimp regions 18 of member 10 closed on the conductor ends. As shown in FIGS. 3 and 4, the act of crimping regions 18 has the effect of tipping the respective hole axes A′ to a position in which these axes form an acute angle with the longitudinal axis of member 10. At such an angle, a cooling fluid can flow through member 10, as indicated by the arrows in FIG. 4, after the tube ends have been slid forward over the outside surface of the member 10. A plurality of flutes 20 formed in the outside surface of member 10 serve to form a seal with the inside surface of the cable tubes. This seal is preferably enhanced by a cable clamp 22 which, depending on cable diameter, may take the form of a ferrule, punch-lock clamp, Otiker clamp, or any type of hose clamp.

From the foregoing description, it will be appreciated that a very simple, yet highly reliable, device has been provided for splicing together two lengths of fluid-cooled electric cable. Not requiring any soldering process, the device lends itself to quick cable repairs and lengthening with simple mechanical tools, i.e., a cable cutter and crimping tool.

While the invention has been described with reference to a preferred embodiment, various modifications, self-evident to those skilled in the art, can be made without departing from the scope of the invention, as defined by the following claims.

I claim:

1. A device for splicing together two lengths of fluid-cooled, electric cable of the type comprising an electrical conductor surrounded by a flexible, fluid-conducting conduit, said splicing device comprising an electrically-conductive tubular member defined by an endless wall of electrically-conductive material, said wall concentrically surrounding an axis to define an axial bore extending from one end of said member to the other, said bore being sized to receive, within the respective distal ends thereof, the respective ends of the conductor portions of a pair of cables which are to be spliced together, at least a portion of said endless wall proximate said distal ends being adapted to be crimped upon received conductor ends to make electrical contact therewith, said endless wall having a pair of holes formed therein which communicate with said bore, said holes being located axially inwardly from said portion of said wall which is adapted to be crimped upon said received conductor ends and in such a location as to be tilted relative to said axis after said wall portion has been crimped upon received conductor ends to allow fluid to flow through a central portion of said axial bore, said tubular member having an outside diameter which is substantially equal to the inside diameter of the fluid-conducting conduit portion of such cable, so that the respective ends of the conduit portion of two lengths of cable can snugly slide over the tubular member from opposite ends.

2. The apparatus as defined by claim 1 wherein the outer surface of said endless wall is provided with flutes for enhancing a fluid seal between said surface and the respective conduit portions of said cables.

3. The apparatus as defined by claim 1 wherein said tubular member has a circular cross-section.

4. The apparatus as defined by claim 1 further comprising a clamp member for clamping the respective conduit portions of such cable lengths to the outer surface of said tubular member.

5. Apparatus for splicing together two lengths of fluid-cooled electric cable, said apparatus comprising an electrically conductive tubular member defined by an endless wall encircling an axis, said wall having a pair of apertures formed therein, said apertures being spaced inwardly from the respective ends of said member, the distal ends of said tubular member being adapted to be crimped closed by a crimping tool, said holes being located to be tilted relative to said axis after said ends have been crimped closed.

* * * * *